US008485719B2

(12) United States Patent
Greubel et al.

(10) Patent No.: US 8,485,719 B2
(45) Date of Patent: Jul. 16, 2013

(54) PIVOT ORGAN

(75) Inventors: Robert Greubel, Lignières (CH); Stephen Edward Methuen Forsey, Les Brenets (CH)

(73) Assignee: CompliTime SA, La Chaux-de-Fonds (CH)

( * ) Notice: Subject to any disclaimer, the term of this patent is extended or adjusted under 35 U.S.C. 154(b) by 461 days.

(21) Appl. No.: 12/933,485

(22) PCT Filed: Mar. 17, 2009

(86) PCT No.: PCT/EP2009/053138

§ 371 (c)(1), (2), (4) Date: Nov. 10, 2010

(87) PCT Pub. No.: WO2009/115519

PCT Pub. Date: Sep. 24, 2009

(65) Prior Publication Data

US 2011/0044141 A1 Feb. 24, 2011

(30) Foreign Application Priority Data

Mar. 18, 2008 (CH) ..... 403/08

(51) Int. Cl.
*G04B 29/00* (2006.01)

(52) U.S. Cl.
USPC ..... 368/324

(58) Field of Classification Search
USPC ..... 368/322, 324–326; 384/492, 625
See application file for complete search history.

(56) References Cited

U.S. PATENT DOCUMENTS

| | | | | |
|---|---|---|---|---|
| 2,027,788 | A | 1/1936 | Ridgway et al. | |
| 2,546,022 | A | 3/1951 | Ulrich | |
| 2,645,078 | A | 7/1953 | Arde | |
| 6,472,062 | B1 * | 10/2002 | Neerinck et al. | 428/336 |
| 8,317,391 | B2 * | 11/2012 | Conus et al. | 368/326 |
| 2002/0114225 | A1 | 8/2002 | Damasko | |

FOREIGN PATENT DOCUMENTS

| | | | |
|---|---|---|---|
| CH | 327798 | A | 2/1958 |
| FR | 1033071 | A | 7/1953 |

OTHER PUBLICATIONS

International Search Report, dated Jul. 10, 2009, from corresponding PCT application.

H. I. Kim et al., "Environmental effected on the friction of hydrogenated DLC films" Tribology Letters, vol. 21, No. 1, Jan. 14, 2006, p. 53.

* cited by examiner

*Primary Examiner* — Vit W Miska
(74) *Attorney, Agent, or Firm* — Young & Thompson

(57) ABSTRACT

A pivot organ (5*a*, 5*b*) designed to allow the rotation of a piece (3) of a clockwork movement around an axis of rotation, includes two elements: a pivot (7*a*, 7*b*) and a bearing (6*a*, 6*b*) receiving the pivot (7*a*, 7*b*), one being integral with the piece (3) and the other being integral with the frame (1) of the movement. The elements (6*a*, 6*b*, 7*a*, 7*b*) have shapes at their opposite surfaces such that the section of one of the elements along a plane perpendicular to the axis of rotation is circular, the section of the other element along the plane being non-circular, so as to reduce the contact surface between the pivot (7*a*, 7*b*) and the bearing (6*a*, 6*b*). At least the contact surfaces of the two elements against each other are made from at least one material intrinsically having a low coefficient of friction and a low wear coefficient.

11 Claims, 4 Drawing Sheets

PIVOT ORGAN

TECHNICAL FIELD

The present invention concerns a pivot organ, designed to allow the rotation of a piece of a clockwork movement around an axis of rotation AA, comprising two elements, i.e. a pivot and a bearing receiving said pivot, one of the elements being integral with said piece and the other being integral with the frame of said movement.

BACKGROUND OF THE INVENTION

Generally, each piece used in clockwork movements includes an arbor provided at both of its ends with pivots, each engaged in a bearing. Pivot organs made up of a bearing and a pivot are traditionally used to ensure axial and radial positioning of the rotating pieces present in the movements.

The pivot is generally made of steel and the bearing is for example made of brass, bronze or ruby, the pairs of materials being chosen such that the frictional torque between the bearing and the pivot is as small and consistent as possible. Thus, according to patent U.S. Pat. No. 2,546,002, it is known to make bearings from precious stones such as diamond or sapphire.

However, the pivot members made from these pairs of materials are still not fully satisfactory regarding the value of the frictional torque obtained. They require lubrication using oil that tends to deteriorate with time.

To try to resolve this problem, patent FR 1 033 071 proposes to modify the shape of the pivots and stones by using a stone having a hole with a circular cross-section and a steel pivot, having, at its surface opposite the stone, a polygonal-shaped cross-section, so as to reduce the contact surfaces between the pivot and the stone. However, this solution is not satisfactory because it still requires lubrication, an oil-sink being provided at the stone.

One aim of the present invention is therefore to offset this drawback, by proposing a pivot organ that makes it possible to further decrease the frictional torque between the bearing and the pivot so as not to require lubrication without, however, affecting wear.

Another aim of the present invention is to propose a pivot organ whereof the elements can be easily manufactured.

BRIEF DESCRIPTION OF THE INVENTION

To this end, and according to the present invention, a pivot organ is proposed that is intended to allow the rotation of a piece of a clockwork movement around a rotational axis AA, comprising two elements, i.e. a pivot and a bearing receiving said pivot, one of the elements being integral with said piece and the other being integral with the frame of said movement, said elements having, at their opposite surfaces, shapes such that the cross-section of one of the elements, along a plane perpendicular to the axis of rotation AA, is circular, the section of the other element along said plane being non-circular, so as to reduce the contact surface between the pivot and the bearing, while ensuring axial and radial positioning of the piece in rotation.

According to the invention, at least the contact surfaces of the two elements against each other are made of at least one material intrinsically having a low coefficient of friction and a low wear coefficient.

Preferably, the two elements are made of at least one material intrinsically having a low coefficient of friction and a low wear coefficient.

Said material intrinsically having a low coefficient of friction and a low wear coefficient can be diamond.

According to a first embodiment, the bearing can have, opposite the pivot, a circular cross-section, the pivot having a polygonal cross-section, the edges of which have been rounded. Advantageously, the pivot can have a square-shaped cross-section, the edges of which have been rounded.

According to another embodiment, the pivot can have a circular cross-section, the bearing being made up of at least three parallelepiped bearing elements, maintained by a bearing support, the face of said bearing elements opposite the pivot being tangent to said pivot.

According to another embodiment, the pivot can have a circular cross-section, the bearing being made up of at least three circular bearing elements, maintained by a bearing support, said bearing elements being arranged tangentially to the pivot. In this case, the bearing support can comprise maintenance elements, with a shape complementary to the circular bearing elements, said maintenance elements not having a contact surface with the pivot.

According to another embodiment, the pivot can have a circular cross-section, the bearing having, on its face opposite the pivot, at least three grooves and at least three bosses, the latter parts being arranged to be tangent to said pivot. In this case, the pivot can have, on its perimeter, a circular groove, arranged to receive said bosses of the bearing.

The present invention also concerns a timepiece comprising at least one pivot organ as defined above.

BRIEF DESCRIPTION OF THE DRAWINGS

Other features of the present invention will appear more clearly upon reading the following description, done in reference to the appended drawing, in which.

DETAILED DESCRIPTION OF THE INVENTION

In this description, a material intrinsically having a low coefficient of friction and a low wear coefficient is any material that ensures its own lubrication, without the help of an outside lubricant. Preferably, this coefficient of friction is less than or equal to 0.1. Moreover, such a material must be hard enough to have a very low wear coefficient. Preferably, said material has a hardness greater than or equal to 9 on the Mohs scale. Preferably, said material is diamond. Any other material having a coefficient of friction and wear coefficient equivalent to those of diamond can be used. Likewise, it is possible to use diamond with another material, or any other mixture of materials having a coefficient of friction and wear coefficient equivalent to those of diamond alone.

In this description, at least the contact surfaces between the pivot and the bearing are made of at least one material intrinsically having a low coefficient of friction and a low wear coefficient. These elements can also be made integrally from at least one material intrinsically having a low coefficient of friction and a low wear coefficient. The frame or just its surface can be made from at least one material intrinsically having a low coefficient of friction and a low wear coefficient, or from any other material.

Figure 1:
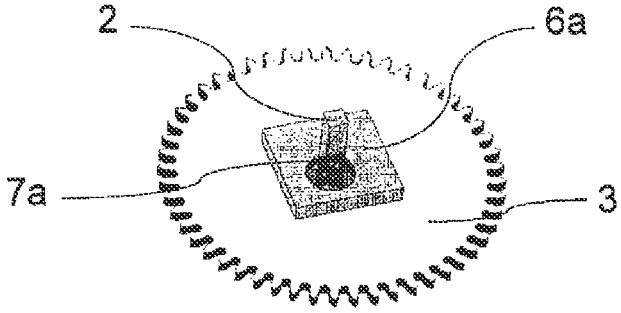
FIGS. 1 and 2 are a perspective view and a cross-sectional view, respectively, of a first embodiment of the invention.
Figure 2:
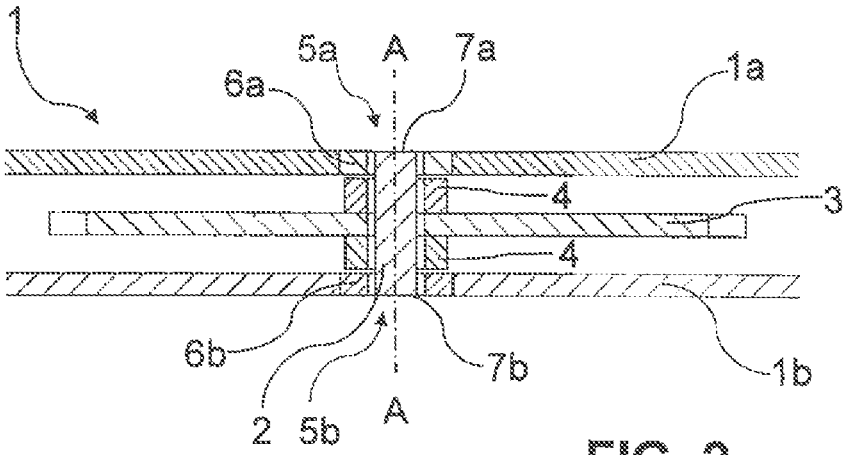
Figure 3:
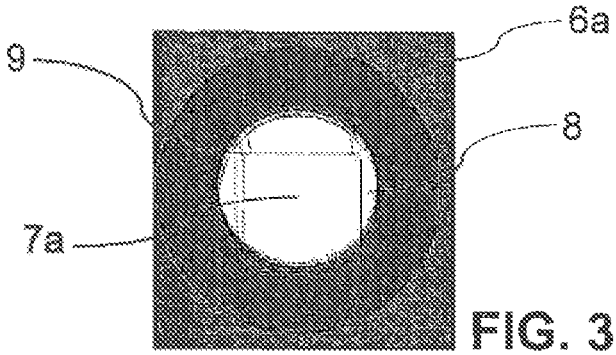
FIG. 3 is a detail view showing the pivot and its bearing, according to the first embodiment.

FIGS. 1 to 3 illustrate part of a timepiece movement, including a frame 1 and wheel and pinion comprising an arbor 2, a board 3 provided with a toothing and two flanges 4 together forming a wheel. The two flanges 4 and the board 3 are made integral with the arbor 2, for example by sticking. The wheel and pinion is mounted freely rotating around an axis AA on the frame 1 using two pivot organs 5*a* and 5*b* that each comprise a bearing 6*a*, 6*b* and a pivot 7*a*, 7*b*, respectively. The pivots 7*a*, 7*b* are formed by the ends of the arbor 2. The bearings 6*a*, 6*b* are mounted on the frame 1, in this case, on a bridge 1*a* and a bottom plate 1*b*, respectively. They are formed by plates driven into the frame 1, for example made of brass. The bearings 6*a*, 6*b* comprise an orifice 8 in their center in which the arbor 2 is engaged.

According to the invention, and in reference more specifically to FIG. 3, the orifice 8 of the bearing 6*a* (or 6*b*) has a circular cross-section, along a plane perpendicular to the axis of rotation AA. Moreover, the arbor 2, and therefore the pivots 7*a* (or 7*b*) have a square cross-section along said plane, the edges 9 thereof being rounded. Thus, the contact surface between the pivots 7*a*, 7*b* and the bearings 6*a*, 6*b*, respectively, is reduced to decrease the frictional torque between these two elements, while also ensuring radial positioning of the arbor 2.

It is quite obvious that the arbor and therefore the pivots can have any other polygonal shape making it possible to reduce the contact surface between the pivot and its bearing, such as a shape with an octagonal, or even triangular cross-section.

The bearings 6*a*, 6*b* and the arbor 2 (and therefore the pivots 7*a*, 7*b*) are made from diamond, for example by chemical vapor deposition (CVD) of diamond on a silicon bottom plate, then are obtained by plasma etching. The arbor 2 can for example be obtained from a bottom plate covered with diamond by CVD, then worked by plasma etching to form bars whereof the width and thickness are equal. These bars are then ground to round their edges.

It is quite obvious that one can provide that only the contact surfaces between the pivot and the bearing, or between the other elements against each other, are made of diamond, for example by covering an element with an outer layer of diamond at its contact surfaces.

The board 3 and the flanges 4 can also be obtained for example by plasma etching from diamond deposited by CVD. They are provided, in their central portion, with a square-shaped hole, the side of which is very slightly higher than the side of the square of the arbor 2.

The diamond has a particularly low coefficient of friction, such that it is not even necessary to lubricate it. Moreover, the diamond supports an extremely high Hertzian pressure. In this way, it is possible to reduce the contact surface between the pivots and the bearings, limiting it to the truncated edges. The diamond, although it is a hard material, can be obtained by CVD and dimensioned by plasma etching. It is thus possible to ensure the pivoting of a wheel and pinion with diamond-on-diamond friction, using pieces manufactured from diamond. The pivot organ according to the invention can be made easily independently of the constraints related to the use of materials intrinsically having a low coefficient of friction and a low wear coefficient.

To produce the wheel and pinion, one slides on the arbor 2 a flange 4, the board 3, then the other flange 4, and fixes the whole thing by sticking, while ensuring the axial positioning of the flanges 4 and the board 3, such that the two ends of the arbor 2 protrude by a fitting length to ensure the function of pivots 7*a*, 7*b*.

The pivot organ thus produced thus comprises a bearing 6*a* or 6*b* provided with a circular hole and a non-circular pivot, in this case square, with rounded edges.

Figure 4:
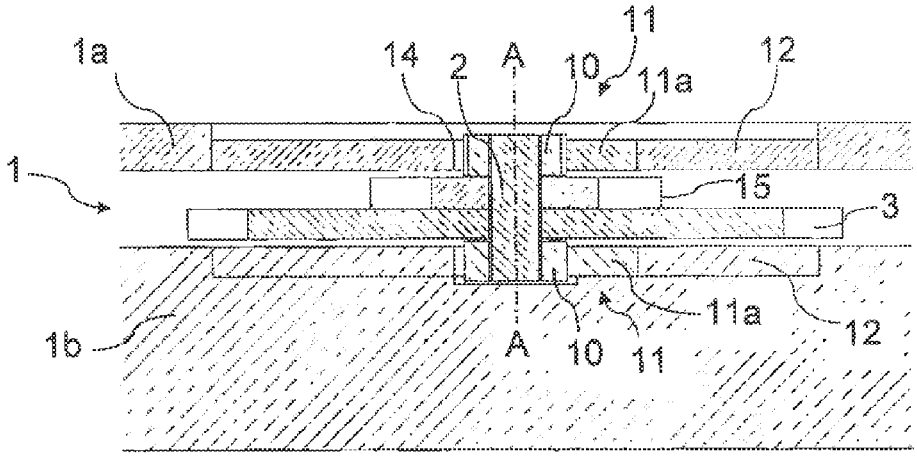
FIG. 4 is a cross-sectional view of another embodiment of the invention.
Figure 5:
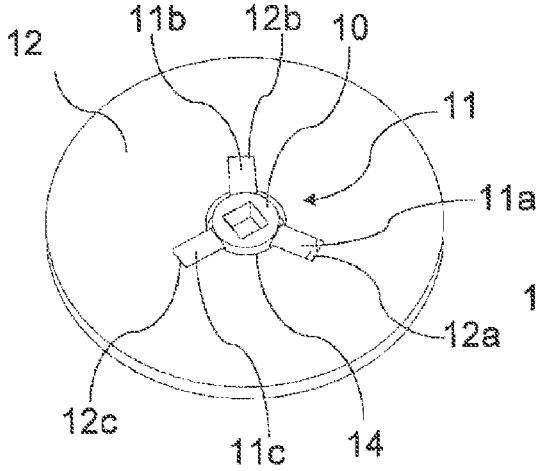
FIGS. 5 and 6 are a detail perspective and top view, respectively, of this other embodiment.
Figure 6:
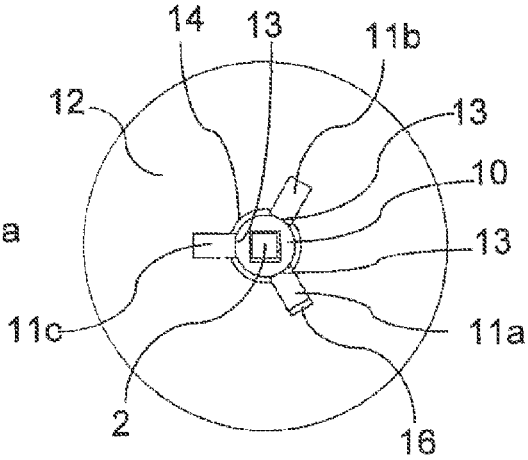

FIGS. 4, 5 and 6 illustrate another embodiment of a pivot organ according to the invention. The elements shared by the first embodiment are shown with the same references. FIG. 4 shows a timepiece movement part, including a frame 1 and a wheel and pinion comprising an arbor 2 with a square-shaped cross-section, a board 3 and its pinion 15 provided with a toothing. The wheel and pinion is mounted free in rotation around an axis AA on the frame 1 using two pivot organs that each comprise a pivot 10 and a bearing 11. The pivots 10 are formed by a ring in which the arbor 2 is engaged, said ring being made integral with the arbor 2 for example by sticking. The bearings 11 are mounted on the frame 1, in this case, on a plate 1*b* and a bridge 1*a*, respectively.

In reference more specifically to FIGS. 5 and 6, the pivot 10, formed by the ring receiving the arbor 2, has a circular cross-section. The bearing 11 is made up of three bearing elements 11*a*, 11*b* and 11*c*, of parallelepiped shape, of rectangular cross-section. The bearing elements 11*a*, 11*b* and 11*c* are arranged around the pivot 10 such that their face 13 opposite said pivot 10 is tangent to said pivot 10.

The pivot organ also comprises a bearing support 12 integral with the frame, for example being driven into the plate 1*a* or into the bridge 1*b*. The bearing support 12 is generally ring-shaped, and is designed to maintain the bearing elements 11*a*, 11*b* and 11*c*. To that end, the bearing support 12 has, on its inner perimeter 14, three notches 12*a*, 12*b*, 12*c* in which the bearing elements 11*a*, 11*b* and 11*c* are engaged and maintained. Play 16 can be provided between the elements 11*a*, 11*b*, 11*c* and their respective notches 12*a*, 12*b*, 12*c* to facilitate mounting and allow adjustment of the elements making it possible to ensure the best possible contact between the pieces. The bearing elements can be maintained in their notches for example by sticking, after their position has been adjusted. The bearing elements can also be maintained by pressure against the ring by elastic means arranged in the space existing between the bottom of the notch and the bearing element.

The bearing support 12 and the bearing elements 11*a*, 11*b* and 11*c* have dimensions such that the inner perimeter 14 of the bearing support 12 is not in contact with the pivot 10, whereas the bearing elements 11*a*, 11*b* and 11*c* protrude from the notches 12*a*, 12*b*, 12*c* to come into contact tangentially with the pivot 10.

Thus, the bearing 11 has a triangular section, the three apices of the triangle corresponding to the three bearing elements 11*a*, 11*b* and 11*c*. Because of this, the contact surface between the pivot 10 and the bearing 11 is reduced, since the contact between the two elements 10 and 11 only happens at the faces 13 of the bearing elements 11*a*, 11*b* and 11*c* tangent to the pivot 10.

In order to obtain the same advantages as for the first embodiment described above, the pivot 10, bearing elements 11*a*, 11*b* and 11*c*, and bearing support 12 are made of diamond through a CVD method and plasma etching.

Figure 11:
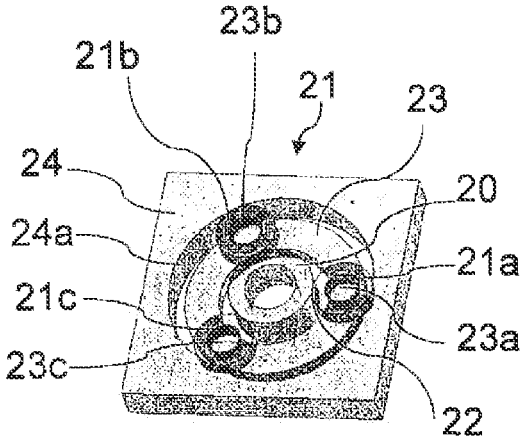
FIG. 11 is a perspective view of another embodiment of the invention.
Figure 12:
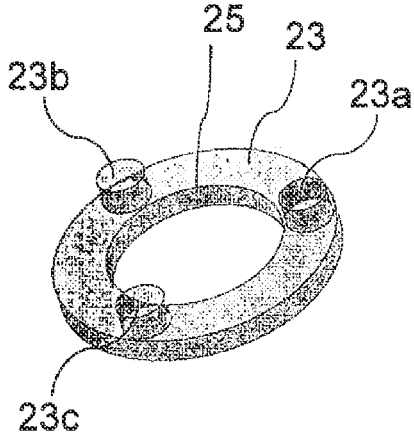
FIG. 12 is a view of the bearing support according to the embodiment of FIG. 11, and FIGS. 13 and 14 are a perspective view and a top view, respectively, of another embodiment of the invention.

FIGS. 11 and 12 illustrate another embodiment of a pivot organ according to the invention. For reasons of clarity, the arbor of the movement, with a square cross-section, is not shown. Only the ring is shown in which said arbor is engaged. According to this alternative, the pivot 20, formed by the ring receiving the arbor, has a circular section and the bearing 21 is formed by three bearing elements 21*a*, 21*b* and 21*c*, of circular annular shape. The bearing elements 21*a*, 21*b* and 21*c* are arranged around the pivot 20 such that their face 22 opposite the pivot 20 is tangent to said pivot 20.

The pivot organ also comprises an annular bearing support 23, designed to maintain the bearing elements 21*a*, 21*b* and 21*c*. To that end, the bearing support 23 has, on its face opposite the bearing elements 21*a*, 21*b* and 21*c*, three cylindrical studs 23*a*, 23*b*, 23*c* around which the bearing elements 21*a*, 21*b* and 21*c* interlock integrally.

Also provided is a support element 24 having, in its center, a circular orifice 24*a*, concentric to the bearing support 23. The support element 24 is integral with the frame.

The dimensions and positioning of the bearing elements 21*a*, 21*b* an 21*c* of the bearing support 23 and of the support element 24 are such that:

- the bearing support 23 is arranged inside the orifices 24*a* of the support element 24 without there being contact between the two pieces 23 and 24,
- the bearing elements 21*a*, 21*b* and 21*c* come tangentially into contact with the support element 24 and are maintained there so as to make the bearing support 23 integral with the frame.

The bearing support 23 and the bearing elements 21*a*, 21*b* and 21*c* have dimensions such that the inner perimeter 25 of the bearing support 23 is not in contact with the pivot 20, whereas the bearing elements 21*a*, 21*b* and 21*c* come tangentially into contact with the pivot 20 by their faces 22.

Thus, the bearing 21 has a generally triangular cross-section, the three apices of the triangle corresponding to the three bearing elements 21*a*, 21*b* and 21*c*. Because of this, the contact surface between the pivot 20 and the bearing 21 is reduced, since the contact between the two elements 20 and 21 only occurs at the faces 22 of the bearing elements 21*a*, 21*b* and 21*c* tangent to the pivot 20.

In order to obtain the same advantages as for the first embodiment described above, the pivot 20, bearing elements 21*a*, 21*b* and 21*c*, and bearing support 23 are made by plasma etching from diamond deposited using a CVD method.

Figure 13:
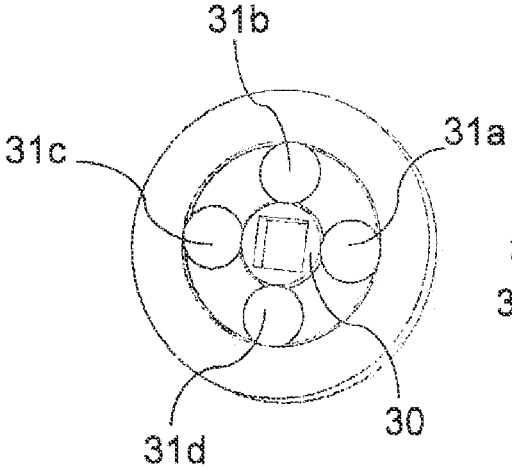
Figure 14:
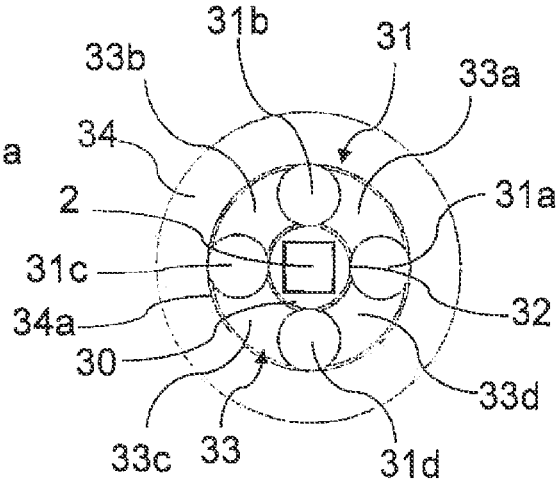

FIGS. 13 and 14 illustrate another embodiment of a pivot organ according to the invention. According to this alternative, the pivot 30, formed by the ring receiving the arbor 2, has a circular section and the bearing 31 is made up of four bearing elements 31*a*, 31*b*, 31*c* and 31*d*, of circular shape. The bearing elements 31*a*, 31*b*, 31*c* and 31*d* are arranged around the pivot 30 such that their face 32 opposite the pivot 30 is tangent to said pivot 30.

The pivot organ also comprises a bearing support 33 made up of four maintenance elements 33*a*, 33*b*, 33*c* and 33*d* of shape complementary to the bearing elements 31*a*, 31*b*, 31*c* and 31*d*, inserted between said bearing elements 31*a*, 31*b*, 31*c* and 31*d*.

Also provided is a support element 34 of annular shape and having, in its center, a circular orifice 34*a*, concentric to the bearing support 33. The support element 34 is integral with the frame.

The dimensions of the four maintaining elements 33*a*, 33*b*, 33*c* and 33*d* are such that, when they are arranged inside the orifice 34*a* of the support element 34, they do not have a contact surface with said support element 34, but are tangentially in contact with the bearing elements 31*a*, 31*b*, 31*c* and 31*d*.

The dimensions and positioning of the bearing elements 31*a*, 31*b*, 31*c* and 31*d* are such that said bearing elements 31*a*, 31*b*, 31*c* and 31*d* also come tangentially into contact with the support element 34 and are maintained there so as to make the bearing support 33 integral with the frame.

Moreover, the bearing support 33 and the bearing elements 31*a*, 31*b*, 31*c* and 31 d have dimensions such that the maintenance elements 31*a*, 31*b*, 31*c* and 31*d* are not in contact with the pivot 30, whereas the bearing elements 31*a*, 31*b*, 31*c* and 31*d* come tangentially into contact with the pivot 30 by their faces 32.

Thus, the bearing 31 has a generally square shape, the four apices of the square corresponding to the four bearing elements 31*a*, 31*b*, 31*c* and 31*d*. Because of this, the contact surface between the pivot 30 and the bearing 31 is reduced, since the contact between the two elements 30 and 31 only occurs at the faces 32 of the bearing elements 31*a*, 31*b*, 31*c* and 31*d* tangent to the pivot 30.

In order to obtain the same advantages as for the embodiments described above, the pivot 30, the bearing elements 21*a*, 21*b* and 21*c*, and the bearing support 23 are produced by plasma etching from diamond deposited through a CVD method.

Figure 7:
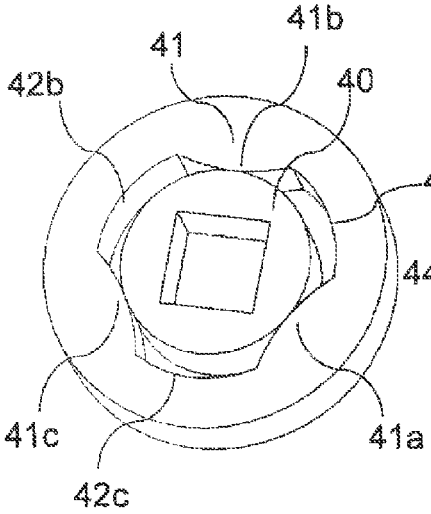
FIGS. 7 and 8 are a perspective and top view, respectively, of another embodiment of the invention.
Figure 8:
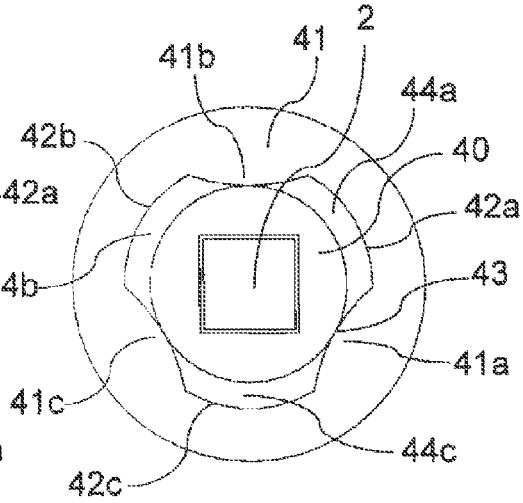

FIGS. 7 and 8 illustrate another embodiment of a pivot organ according to the invention. According to this alternative, the pivot 40, formed by the ring receiving the arbor 2, has a circular section and the bearing 41 has, on its face opposite the pivot 40, three bosses 41*a*, 41*b* and 41*c*, and three grooves 42*a*, 42*b* and 42*c*.

The bosses 41*a*, 41*b* and 41*c* are arranged around the pivot 40 such that their face 43 opposite the pivot 40 is tangent to said pivot 40. Because of this, the contact surface between the pivot 40 and the bearing 41 is reduced, since the contact between the two elements 40 and 41 only occurs at the faces 43 of the bosses 41*a*, 41*b* and 41*c* tangent to the pivot 40.

Advantageously, the free spaces 44*a*, 44*b* and 44*c* existing between the pivot 40 and the three grooves 42*a*, 42*b* and 42*c* can be used as oil-sinks and receive a lubricant, if one must further reduce friction.

In order to obtain the same advantages as for the embodiments described above, the pivot 40 and the bearing 41 are produced by plasma etching from diamond deposited through a CVD method.

Figure 9:
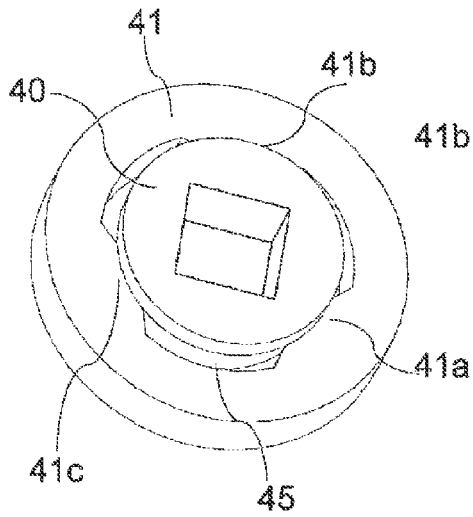
FIGS. 9 and 10 are a perspective view and a bottom view, respectively, of another embodiment of the invention.
Figure 10:
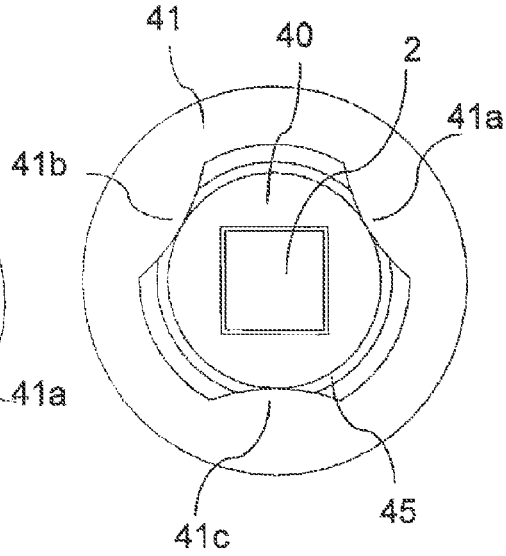

FIGS. 9 and 10 illustrate another embodiment of a pivot organ according to the invention, very similar to that shown in FIGS. 7 and 8. In FIGS. 9 and 10, the elements are used again with the same references used for FIGS. 7 and 8. According to this alternative, the pivot 40, formed by the ring receiving the arbor 2, has, on its perimeter, a circular groove 45 in which the three bosses 41*a*, 41*b* and 41*c* are engaged. The groove 45 can be obtained by producing a pivot having an upper crown and a stem, the stem having a smaller diameter than that of the upper crown.

It is obvious that the shapes of the elements of the invention are not limited to this description. In particular, one can provide for making a frame in diamond, comprising an orifice for receiving the pivot, said orifice corresponding to the orifice of the bearing in which the pivot is engaged, the bearing then being an integral part of said frame.

The invention claimed is:

1. A pivot organ designed to allow the rotation of a piece of a clockwork movement around an axis of rotation AA, comprising two elements, i.e. a pivot and a bearing receiving said pivot, one of said elements being arranged to be integral with said piece and the other being arranged to be integral with a frame of said movement, said elements having, at their opposite surfaces, shapes such that the section of one of the elements along a plane perpendicular to the axis of rotation AA is circular, the cross-section of the other element along said plane being non-circular, so as to reduce the contact surface between the pivot and the bearing, wherein at least the contact surfaces of the two elements against each other are made from at least one material ensuring its own lubrication, having a coefficient of friction less than or equal to 0.1 and a hardness greater than or equal to 9 on the Mohs scale.

2. The organ according to claim 1, wherein the two elements are made from at least one material ensuring its own lubrication, having a coefficient of friction less than or equal to 0.1 and a hardness greater than or equal to 9 on the Mohs scale.

3. The organ according to claim 1, wherein said material ensuring its own lubrication, and having a coefficient of friction less than or equal to 0.1 and a hardness greater than or equal to 9 on the Mohs scale, is diamond.

4. The organ according to claim 1, wherein the bearing, opposite the pivot, has a circular section, and wherein the pivot has a polygonal section, the edges of which have been rounded.

5. The organ according to claim 4, wherein the pivot has a square section, the edges of which have been rounded.

6. The organ according to claim 1, wherein the pivot has a circular section, and wherein the bearing is made up of at least three bearing elements of parallelepiped shape, maintained by a bearing support, the face of said bearing elements opposite the pivot being tangent to said pivot.

7. The organ according to claim 1, wherein the pivot has a circular section, and wherein the bearing is made up of at least three circular bearing elements, maintained by a bearing support, said bearing elements being arranged tangentially to the pivot.

8. The organ according to claim 7, wherein the bearing support comprises maintenance elements, with a shape complementary to the bearing elements, circular, said maintenance elements not having a contact surface with the pivot.

9. The organ according to claim 1,wherein the pivot has a circular section and wherein the bearing has, on its face opposite the pivot, at least three grooves, and at least three bosses arranged to be tangent to said pivot.

10. The organ according to claim 9, wherein the pivot has, on its perimeter, a circular groove, arranged to receive said bosses of the bearing.

11. A piece of a clockwork movement, comprising at least one pivot organ designed to allow the rotation of said piece around an axis of rotation AA, said pivot organ comprising two elements, i.e. a pivot and a bearing receiving said pivot, one of said elements being arranged to be integral with said piece and the other being arranged to be integral with a frame of said movement, said elements having, at their opposite surfaces, shapes such that the section of one of the elements along a plane perpendicular to the axis of rotation AA is circular, the cross-section of the other element along said plane being non-circular, so as to reduce the contact surface between the pivot and the bearing, wherein at least the contact surfaces of the two elements against each other are made from at least one material ensuring its own lubrication, having a coefficient of friction less than or equal to 0.1 and a hardness greater than or equal to 9 on the Mohs scale.

* * * * *

UNITED STATES PATENT AND TRADEMARK OFFICE

CERTIFICATE OF CORRECTION

PATENT NO. : 8,485,719 B2
APPLICATION NO. : 12/933485
DATED : July 16, 2013
INVENTOR(S) : Greubel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 512 days.

Signed and Sealed this
Eighth Day of September, 2015

Michelle K. Lee

Michelle K. Lee
*Director of the United States Patent and Trademark Office*